US005531973A

United States Patent [19]

Sarv

[11] Patent Number: 5,531,973

[45] Date of Patent: Jul. 2, 1996

[54] PRODUCTION OF PLASMA GENERATED $NO_x$ REDUCING PRECURSORS FROM A MOLECULAR NITROGEN AND HYDROCARBON MIXTURE

[75] Inventor: Hamid Sarv, Canton, Ohio

[73] Assignee: The Babcock & Wilcox Company, New Orleans, La.

[21] Appl. No.: 393,600

[22] Filed: Feb. 23, 1995

Related U.S. Application Data

[63] Continuation-in-part of Ser. No. 198,929, Feb. 18, 1994, abandoned.

[51] Int. Cl.[6] ..... B01D 53/56

[52] U.S. Cl. ..... 423/235; 423/DIG. 10

[58] Field of Search ..... 423/235, 235 D, 423/236, DIG. 10

[56] References Cited

U.S. PATENT DOCUMENTS

| | | | |
|---|---|---|---|
| 4,878,830 | 11/1989 | Henderson | 431/10 |
| 4,985,219 | 1/1991 | Helfritch et al. | 423/235 |
| 5,020,457 | 6/1991 | Mathur et al. | 110/345 |
| 5,139,755 | 8/1992 | Seeker et al. | 423/235 |
| 5,229,090 | 7/1993 | Hofmann et al. | 423/235 |

FOREIGN PATENT DOCUMENTS

| | | | |
|---|---|---|---|
| 5123468 | 2/1976 | Japan | 423/235 D |
| 5450471 | 4/1979 | Japan | 423/235 D |
| 4100514 | 4/1992 | Japan | 423/235 |
| 4171022 | 6/1992 | Japan | 423/DIG. 10 |
| 5-96129 | 4/1993 | Japan | 423/DIG. 10 |

OTHER PUBLICATIONS

"Removal of $NO_x$ and $CH_3Cl$ by Reaction Methods", Industrial Heating, 1993 pp. 47–48. Feb. 1993.

Behbahani, H. F. et al., "The Destruction of Nitric Oxide by Nitrogen Atoms from Plasma Jets",*Comb. Sci. & Tech. 27,* 123–132, 1982.

Behbahani, H. F. et al., "The Destruction of Nitric Oxide by Nitrogen Atoms from Plasma Jets," *Comb. Sci. & Tech. 30,* 289–302, 1983.

Hilliard, J. C. et al., "Nitric Oxide Reduction by Radiative Cooling of Natural Gas Flames Seeded by Plasma Generated Carbon Particles," *Fossil Fuels Comb. Symp.,* PD–vol. 25, Book No. H00453, 1989.

*Primary Examiner*—Gary P. Straub
*Assistant Examiner*—Timothy C. Vanoy
*Attorney, Agent, or Firm*—Daniel S. Kalka; Robert J. Edwards

[57] ABSTRACT

A method for reducing $NO_x$ produced by the burning of fuels includes providing a hydrocarbon and nitrogen mixture to a plasma arc generator for producing $NO_x$ reducing precursors which are, in turn, provided near the burning of the fuel for reacting and reducing $NO_x$ emissions. These precursors include N, H, HCN, $CH_i$ and $NH_i$, etc.

11 Claims, 2 Drawing Sheets

PRODUCTION OF PLASMA GENERATED $NO_X$ REDUCING PRECURSORS FROM A MOLECULAR NITROGEN AND HYDROCARBON MIXTURE

This is a continuation-in-part of application Ser. No. 08/198,929, filed Feb. 18, 1994, now abandoned.

BACKGROUND OF THE INVENTION

1. Field of the Invention

The present invention relates, in general, to the reduction of $NO_x$ emissions, and in particular to, a new and useful method for reducing $NO_x$ utilizing a plasma generator and molecular nitrogen and hydrocarbon mixture.

2. Description of the Related Art

Nitrogen oxides ($NO_x$), such as NO and $NO_2$, are among the most regulated combustion-generated pollutants known. $NO_x$ is formed in several different manners. One manner is the direct oxidation of molecular nitrogen ($N_2$) which forms NO and is commonly referred to as thermal $NO_x$. Reactions of molecular nitrogen and hydrocarbon radicals produce amines and cyano compounds which if oxidized form the so-called prompt $NO_x$. $NO_x$ is also formed from the combustion of nitrogen-bearing fuels such as coals or oils.

Because the production of $NO_x$ has become such a major environmental problem, fuel pyrolysis in an oxygen deficient region has been used in order to produce species that react with $NO_x$ in order to convert it to molecular nitrogen. This method has been applied to many types of fossil fuel burners in order to provide $NO_x$ emissions control.

Another method for reducing $NO_x$ is to utilize plasma jets of nitrogen. Laboratory researchers utilized nitrogen atoms to remove NO from simulated flue gas. In that study, pure molecular nitrogen ($N_2$) was disassociated to monatomic nitrogen (N) by passing the $N_2$ through a high temperature, aerodynamically spun plasma arc. The principle reaction is described as:

$$N+NO \rightarrow N_2+O$$

At another laboratory, a plasma torch was developed which was able to breakdown methane molecules and seed a natural gas flame with carbon radicals. The presence of these radicals reduced the thermal $NO_x$ through enhanced flame luminosity and radiative heat loss.

Up till now, most of the other $NO_x$ reduction methods utilizing plasma generation have involved only nitrogen or natural gas as pointed out above. Presently, there is no known system or method for providing a higher formation of $NO_x$ reducing species through plasma generation.

SUMMARY OF THE INVENTION

The present invention relates to the reduction of $NO_x$ emissions using a mixture of molecular nitrogen and hydrocarbon in conjunction with a high temperature plasma torch or plasma arc generator.

In order to reduce $NO_x$ produced by the burning of a fuel, a hydrocarbon and nitrogen mixture is supplied to a nitrogen plasma generator which produces a pool of $NO_x$ reducing precursors. These precursors are provided at the fuel-rich reaction zone near the burning of the fuel for reacting with and reducing the $NO_x$.

The $NO_x$ reducing precursors include N; HCN; $CH_i$, i=1, 2, 3; $NH_i$, i=1, 2, 3; etc.

The present invention is used in conjunction with low $NO_x$ combustion systems for reducing $NO_x$. These systems include a low $NO_x$ burner, a fuel reburner, and a staged combustor which utilizes fuel staging combustion.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
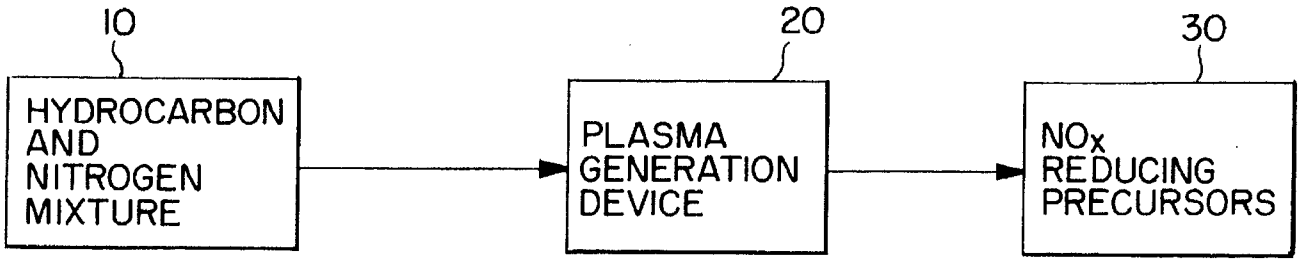
FIG. 1 is a schematic view of the present invention.

As shown in FIG. 1, the present invention utilizes a hydrocarbon and nitrogen mixture 10 which is supplied to a plasma device 20, which is a high temperature plasma torch or plasma arc generator, for producing a pool of $NO_x$ reducing precursors 30 which comprise N, H, HCN, CN, $CH_i$ and $NH_i$, where i=1, 2, 3 etc. Many hydrocarbons can be utilized by the present invention including natural gas.

The chemical reactions leading to NO removal and conversion to $N_2$ are similar to those found in fuel-rich flames. However, the high temperature plasma generator device 20 supplied with a blend of nitrogen and hydrocarbons 10 can boost the concentrations of $NO_x$ reducing species 30 to levels exceeding those found in fuel-rich flames. Subsequent introduction of these species into a combustion chamber further removes $NO_x$ according to the following major reactions:

$$CH_i+NO \rightarrow HCN$$

$$CH_i+N_2 \rightarrow HCN$$

$$HCN \rightarrow NH_i \rightarrow N$$

$$NH_i+NO \rightarrow N_2$$

$$N+NO \rightarrow N_2$$

For a given application, the ratio of the hydrocarbon source to nitrogen and the flow rate of the mixture should be optimized for best performance.

Figure 2:
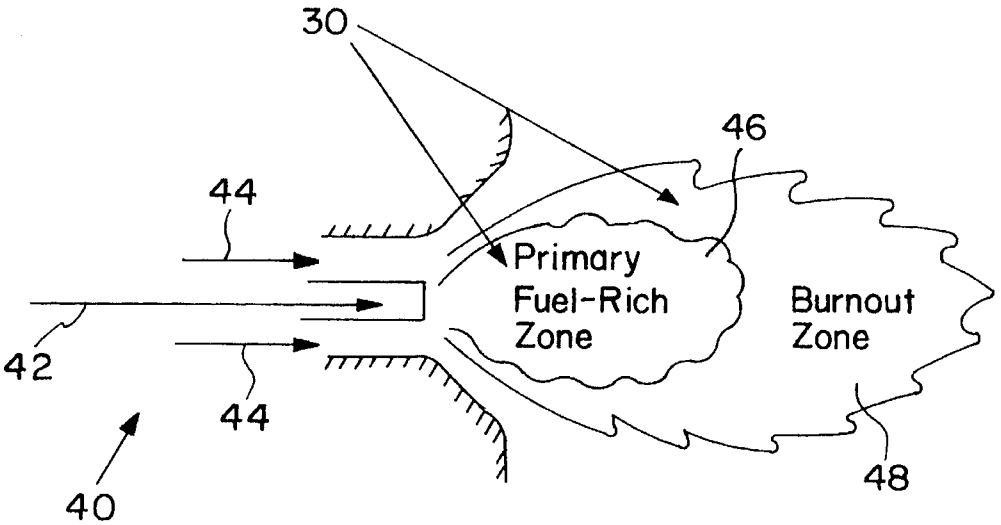
FIG. 2 ms a schematic view of the present invention used in conjunction with a burner.
Figure 3:
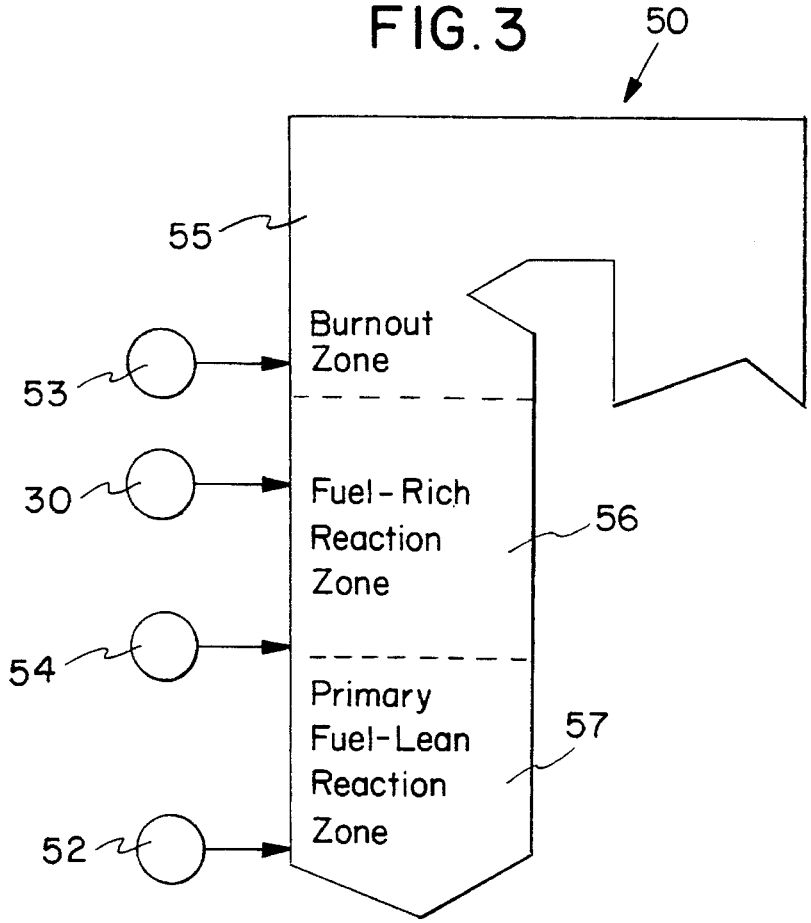
FIG. 3 is a schematic view of the present invention used in conjunction with a reburner.

As shown in FIG. 2, the plasma-generated species 30 is used in conjunction with a burner 40 having a primary channel of air and fuel 42 and excess air channels 44, which when burned produces a primary fuel-rich zone 46 followed by a burnout zone 48. In the low-$NO_x$ burners 40, oxygen-lean regions of fossil fuel burned such as coals, natural gas or oils are ideal for injecting the plasma-generated species 30. As illustrated in FIG. 3, the present invention is used in connection with a fuel reburner 50 having a primary fuel-lean reaction zone 57 which receives a fuel and air source 52 and a fuel-rich reaction zone 56 which is created by the reburning of fuel and air at 54. A burnout zone 55 which receives overfire excess air 53 is above the fuel-rich reaction zone 56. The plasma-generated species 30 is provided to the fuel-rich reaction zone 56 at a temperature equal to or greater than about 100° C. as a supplementary fuel injection downstream of the fuel-lean reaction zone or main reaction zone 57 in order to produce $NO_x$ reducing conditions. The introduction of the plasma-generated species 30 into the burning zone 56 further enhances $NO_x$ reduction.

Figure 4:
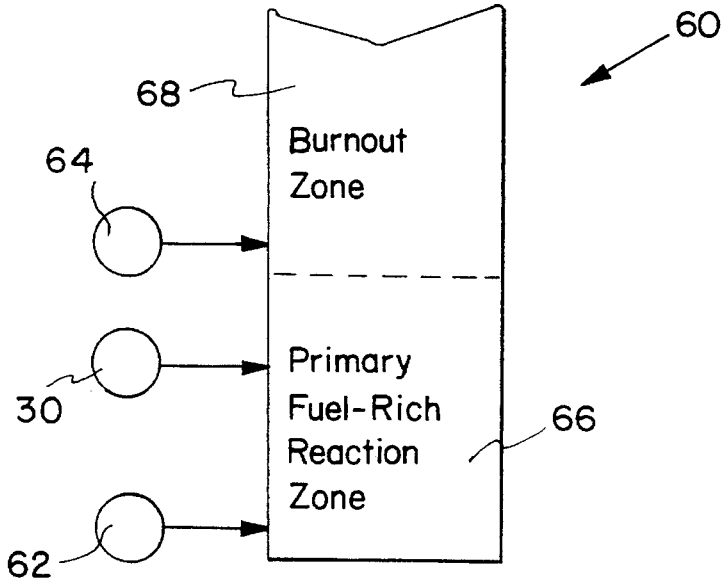
FIG. 4 is a schematic view of the present invention used in conjunction with a staged combustor.

FIG. 4 illustrates a staged fuel combustor 60 which burns a fuel and air mixture 62 at a primary fuel-rich reaction zone 66. Excess air 64 is provided above the main reaction zone 66 forming a burnout zone 68. According to the present invention, the plasma-generated species 30 is injected into the main fuel-rich zone 66 where oxidizer concentrations are low. In this application, the injection of the plasma generated species 30 enhances the reduction of the $NO_x$.

According to the present invention, any hydrocarbon species such as alkyl or aromatic compounds are blended with molecular nitrogen and supplied to the plasma generator device 20 (FIG. 1). Some of the oils and liquid-phase carbons which can be utilized by the present invention may require atomization or prevaporization prior to mixing.

The present invention provides for higher concentrations of $NO_x$ reducing species to be formed relative to the levels generated in the $NO_x$ reducing combustion zones. The present invention provides for additional formation of $NO_x$ reducing species compared to other plasma generation concepts which involve only nitrogen or natural gas. The present invention also provides for higher infurnace $NO_x$ control and lower post-combustion $NO_x$ control needs.

While specific embodiments of the invention have been shown and described in detail to illustrate the application of the principles of the invention, it will be understood that the invention may be embodied otherwise without departing from such principles.

What is claimed is:

1. A method for reducing $NO_x$ produced by a burning of a fuel, the method comprising the steps of:

burning a fuel with a low $NO_x$ burner to produce a primary fuel-rich combustion zone which produces $NO_x$ followed by a burnout zone;

providing a hydrocarbon and nitrogen mixture;

providing a plasma generator;

supplying the hydrocarbon and nitrogen mixture to the plasma generator for producing $NO_x$ reducers; and providing the $NO_x$ reducers to the fuel-rich combustion zone which is at a temperature exceeding 1000° C. for reacting with the $NO_x$.

2. The method according to claim 1, wherein the $NO_x$ reducers comprise N, H, HCN, $CH_i$ and $NH_i$.

3. The method according to claim 1, wherein the plasma generator is a high temperature plasma torch.

4. The method according to claim 1, wherein the plasma generator is a high temperature plasma arc generator.

5. A method for reducing $NO_x$ produced by a burning of a fuel, the method consisting essentially of the steps of:

burning a fuel to produce a primary fuel-rich combustion zone which produces $NO_x$ followed by a burnout zone;

providing a hydrocarbon and nitrogen mixture;

providing a plasma generator;

supplying the hydrocarbon and nitrogen mixture to the plasma generator for producing $NO_x$ reducers; and providing the $NO_x$ reducers to the fuel-rich combustion zone which is at a temperature exceeding 1000° C. for reacting with the $NO_x$.

6. The method according to claim 5, wherein the $NO_x$ reducers comprise N, H, HCN, $CH_i$ and $NH_i$.

7. The method according to claim 5, wherein the fuel is burned by a burner.

8. The method according to claim 6, wherein the fuel is burned by a reburner.

9. The method according to claim 5, wherein the fuel is burned by a staged combustor.

10. The method according to claim 5, wherein the plasma generator is a high temperature plasma torch.

11. The method according to claim 5, wherein the plasma generator is a high temperature plasma arc generator.

* * * * *

UNITED STATES PATENT AND TRADEMARK OFFICE

CERTIFICATE OF CORRECTION

PATENT NO. : 5,531,973

DATED : Jul. 2, 1996

INVENTOR(S) : Hamid Sarv

It is certified that error appears in the above-identified patent and that said Letters Patent is hereby corrected as shown below:

In Col. 3, line 7, 100°C is --1000°C--.

Signed and Sealed this

Twenty-sixth Day of November 1996

*Attest:*

Bruce Lehman

BRUCE LEHMAN

*Attesting Officer*

*Commissioner of Patents and Trademarks*